US010471726B2

(12) United States Patent
Woodlock et al.

(10) Patent No.: US 10,471,726 B2
(45) Date of Patent: Nov. 12, 2019

(54) RETAINERS

(71) Applicant: Hewlett-Packard Development Company, L.P., Houston, TX (US)

(72) Inventors: David Woodlock, Vancouver, WA (US); Ben Mergen, Vancouver, WA (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 0 days.

(21) Appl. No.: 15/759,942

(22) PCT Filed: Dec. 18, 2015

(86) PCT No.: PCT/US2015/066635

§ 371 (c)(1),
(2) Date: Mar. 14, 2018

(87) PCT Pub. No.: WO2017/105487

PCT Pub. Date: Jun. 22, 2017

(65) Prior Publication Data

US 2018/0264828 A1 Sep. 20, 2018

(51) Int. Cl.
*B41J 2/175* (2006.01)

(52) U.S. Cl.
CPC ..... *B41J 2/1752* (2013.01); *B41J 2/175* (2013.01); *B41J 2/1753* (2013.01); *B41J 2/17553* (2013.01)

(58) Field of Classification Search
CPC ..... B41J 2/1752
See application file for complete search history.

(56) References Cited

U.S. PATENT DOCUMENTS 5,245,361 A * 9/1993 Kashimura ..... B41J 25/34 346/145
5,748,210 A * 5/1998 Watanabe ..... B41J 2/1752 347/50
6,293,649 B1 * 9/2001 Norton ..... B41J 2/1752 347/37
6,312,105 B1 11/2001 Miyauchi
(Continued)

FOREIGN PATENT DOCUMENTS

WO WO-2014141337 9/2014

OTHER PUBLICATIONS

How to Unpack and Change the Cartridges on Lexmark Inkjet and All-in-One Printers—http://support.lexmark.com/ ~ Oct. 2015 ~ 3 pages.

(Continued)

*Primary Examiner* — Shelby L Fidler
(74) *Attorney, Agent, or Firm* — HP Inc. Patent Department

(57) ABSTRACT

In an example, a retainer may comprise a latch to removably engage with a cartridge, an actuator plate to operably engage with the cartridge, a bias member, and a linkage. The actuator plate may operably engage with the cartridge such that, upon engagement with the cartridge, the transmission of signals can occur between the actuator plate and the cartridge. The linkage may be engaged with the actuator plate, the bias member, and the latch, such that linkage causes the actuator plate to be pushed against the cartridge upon the latch being engaged with the cartridge in a locked position.

15 Claims, 5 Drawing Sheets

(56) References Cited

U.S. PATENT DOCUMENTS

| | | | | |
|---|---|---|---|---|
| 7,380,993 | B2 | 6/2008 | Dallesasse | |
| 7,515,778 | B2 | 4/2009 | Mosinskis et al. | |
| 8,948,608 | B1 | 2/2015 | Pobanz | |
| 2002/0135634 | A1 | 9/2002 | Lodal et al. | |
| 2007/0279464 | A1* | 12/2007 | Harazim | B41J 2/1752 347/86 |
| 2008/0038037 | A1 | 2/2008 | Devore et al. | |
| 2010/0007700 | A1* | 1/2010 | Muhl | B41J 2/1752 347/49 |
| 2011/0229149 | A1 | 9/2011 | Grubb et al. | |
| 2012/0169816 | A1 | 7/2012 | Iwata et al. | |
| 2013/0294546 | A1 | 11/2013 | Emami-Neyestanak et al. | |
| 2014/0321864 | A1 | 10/2014 | Bliss et al. | |
| 2015/0258831 | A1* | 9/2015 | Faber | B41J 2/1752 101/333 |
| 2015/0298459 | A1 | 10/2015 | Yasumoto et al. | |

OTHER PUBLICATIONS

Wu—Dissertation ~ "High Performance Optical Transmitter for Next Generation Supercomputing and Data Communication". 2013. 184 pages.

Wu, et al. A 20Gb/s NRZ/PAM-4 1V transmitter in 40nm CMOS driving a Si-photonic modulator in 0.13 μm CMOS. ~ IEEE ~ 2013 ~ 3 pages.

* cited by examiner

RETAINERS

BACKGROUND

Printing systems may deposit printing fluid, such as ink, or another printing substance, such as three-dimensional printing powder, on print media. The printing system may deposit the printing substance on the print media from a cartridge. The cartridge may be disposed within the priming system, and further, the cartridge may be removable from the priming system.

DETAILED DESCRIPTION

Figure 1A:
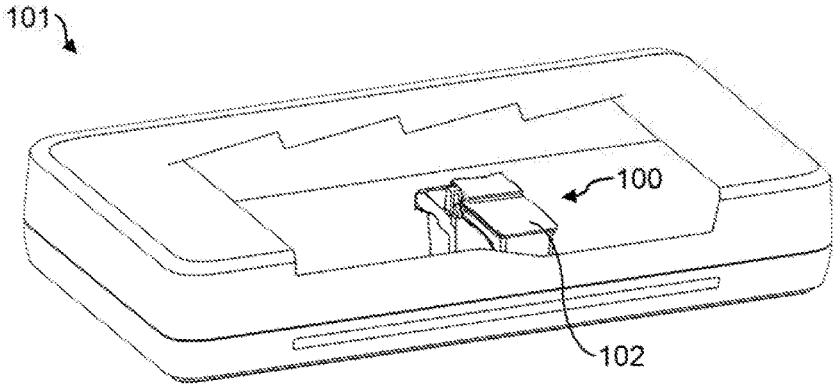
FIG. 1A is a perspective view of an example retainer disposed within an example printing system.

Printing systems may deposit printing fluid, such as ink, for example, on media or prim media. In some situations, priming systems may deposit other print substances on media, such as powder, for example, in a powder-based three-dimensional (3D) printer. The printing system may deposit the printing substance on the print media from a cartridge. The cartridge may be disposed within the printing system, and further, the cartridge may be removable from the printing system. In some situations, the cartridge may be replaceable, such that, upon depletion of the print substance disposed within the cartridge, the cartridge may be replaced with another cartridge having print substance disposed within.

The cartridge may electrically, optically, or otherwise communicate with the printing system such that the transmission of communication signals between the cartridge and printing system can occur while the cartridge is installed within the printing system. The communication may occur between a communication interface disposed on each of the cartridge and the printing system. Upon removal of the cartridge from the printing system, the communication interface disposed on the cartridge may be disengaged from the communication interface disposed within the printing system, and, thus, the ability to communicate or transmit and receive signals between the two may be ceased. Upon reinstallation of the cartridge or installation of a new cartridge into the printing system, the communication interface of the printing system may be engaged with the communication interface of the cartridge, and communication or transmission and reception of communication signals may again be possible.

Upon installation or insertion of the cartridge into the printing system, the communication interface of the cartridge may engage with the communication interface of the printing system with a force sufficient to make the communication engagement robust. In other words, a certain amount of force may be maintained between the cartridge communication interface and the printing system communication interface such that reliable transmission and reception of communication signals may occur between the two interfaces. In some situations, the engagement force between the two communication interfaces may be great enough to make the cartridge installation process difficult for a user. If the cartridge is installed into the printing system incorrectly, the electronics or other components of the communication interface of the cartridge and/or the printing system may be damaged by the engagement force between the communication interfaces. For example, if the communication interfaces scrape, rub, or slide against each other during cartridge installation, the engagement force of the communication interfaces may cause damage to one or both of the communication interface of the cartridge, and the communication interface of the printing system.

In order to avoid harmful interference between the cartridge communication interface and the printing system communication interface during cartridge installation, some printing systems may employ complex and non-intuitive mechanics for cartridge installation to be carried out by a user when replacing or installing a cartridge. One such complex mechanical setup is installing a cartridge into the printing system through a rocking motion. This mechanical procedure may entail a user installing the cartridge at a non-parallel angle, or in other words, a non-parallel angle relative to the final position of the cartridge and the printing system communication interface, and then rocking or pivoting the cartridge into pace, engaging the communication interface of the cartridge with that of the printing system with the requisite amount of engagement force. This type of installation procedure may be confusing and non-intuitive to a user, and may cause the user to commit incorrect installation attempts before a successful installation of the cartridge is performed. The unsuccessful or incorrect installation attempts may damage the communication interface of the cartridge and/or the printing system. Further, using a rocking motion to install cartridges comprising a certain geometry may cause the cartridge to impact and interfere with other components of the printing system when the cartridge is inserted at the initial, non-parallel angle. For example, installing a longer cartridge at an angle, or at a position other than the final operating position of the cartridge, may cause the cartridge to initially interfere with, for example, components of the print media path within the printing system until the cartridge is rocked or pivoted into its final position. This initial interference of the cartridge and other components of the printing system may cause damage to the printing system, and thus, may result in the printing system being designed with a non-optimal structure, size, or layout, just for the sake of the cartridge installation procedure.

In some situations, it may be desirable to have a printing system with the ability to install a cartridge directly into its final operating position to avoid unnecessary interference with other components of the printing system. Such a printing system may also provide a simpler and more intuitive installation process for a user such that the user avoids committing incorrect or unsuccessful installation attempts, thereby avoiding potential damage to the cartridge or printing system. Additionally, it may be desirable for the installation of the cartridge to avoid damaging interference or contact between the cartridge communication interface and the printing system interface from the engagement force of the interfaces.

Implementations of the present disclosure provide retainers to retain cartridges within printing systems. Example retainers provide the ability for the cartridge to be installed or inserted directly into is operating position instead of having to be subsequently rocked or pivoted into its operating position after insertion. Further, the example retainers provide an installation procedure that is simple and intuitive for a user so as to avoid the user committing unsuccessful or incorrect installation attempts. The installation of a cartridge into an example retainer may also avoid potentially damaging interference between a communication interface of the cartridge and a communication interface of the printing system by applying the interface engagement force to the communication interfaces after the cartridge is inserted into the retainer, and thus, the printing system.

Referring now to FIG. 1A, a perspective view of an example retainer 100 disposed within an example printing system 101, and having a cartridge 102 installed within the retainer 100 is illustrated. The printing system 101 may be a device to deposit a printing substance, such as ink, or 3D print material or powder, in some implementations, upon print media. In some implementations, the print media may be paper, or other two-dimensional print media. The print substance may be disposed within and, during a printing operation, withdrawn or ejected from the cartridge 102 onto the print media. In further implementations, the cartridge 102 may be another element of the printing system, or a removable element of the printing system.

Figure 1B:
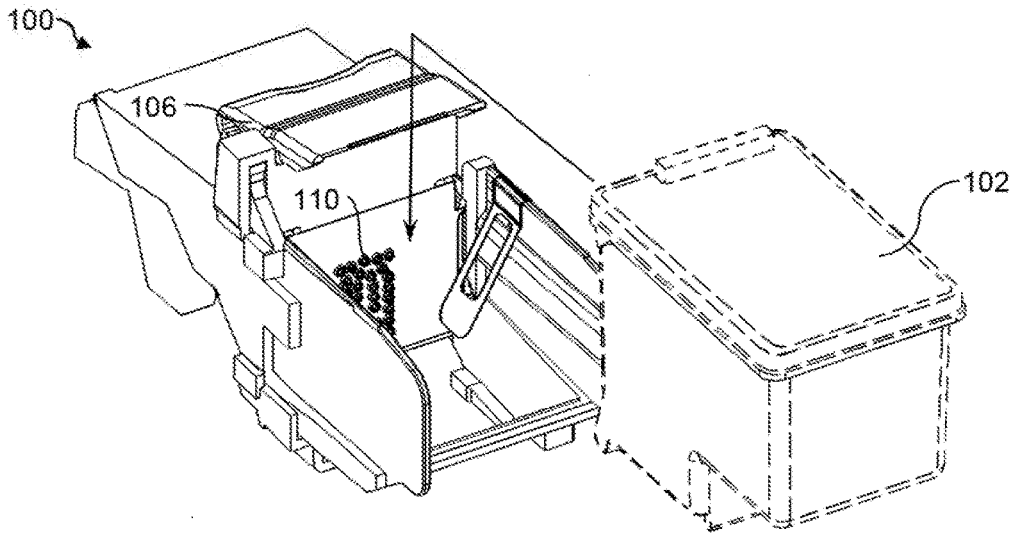
FIG. 1B is a perspective view of an example retainer.

Referring additionally to FIG. 1B, a perspective view of an example retainer 100 is illustrated with a cartridge 102 shown removed, uninstalled, or prior to being installed from the retainer 100. To install the cartridge 102, the cartridge may be inserted along the indicated direction, directly to its operating position within the retainer 100. The operating position may refer to the position within the retainer 100 that the cartridge 102 is disposed in during printing operations. The retainer 100 may include a latch 106, an actuator plate 110, a bias member, and a linkage. Note, the bias member, and the linkage are not shown in FIG. 1B. In some implementations, the retainer 100 may further include a carriage 104. In some implementations, the carriage 104 may be considered to be part of the printing system 101 other than part of the retainer 100. The carriage 104, in some implementations, may be a rigid or semi-rigid structural element, component, or assembly within the printing system 101. The carriage 104 may be constructed such that it may receive a cartridge 102 or a portion of a cartridge 102. In some implementations, the carriage may be fixed within the printing system 101. In other implementations, the carriage 104 may be movable relative to print media within the printing system 101: In further implementations, the carriage 104 may fixably receive a cartridge 102 within the carriage 104 such that, when the carriage 104 moves relative to print media within the printing system, the cartridge 102 also moves relative to the print media, such as in an inkjet printer, in some implementations.

Figure 1C:
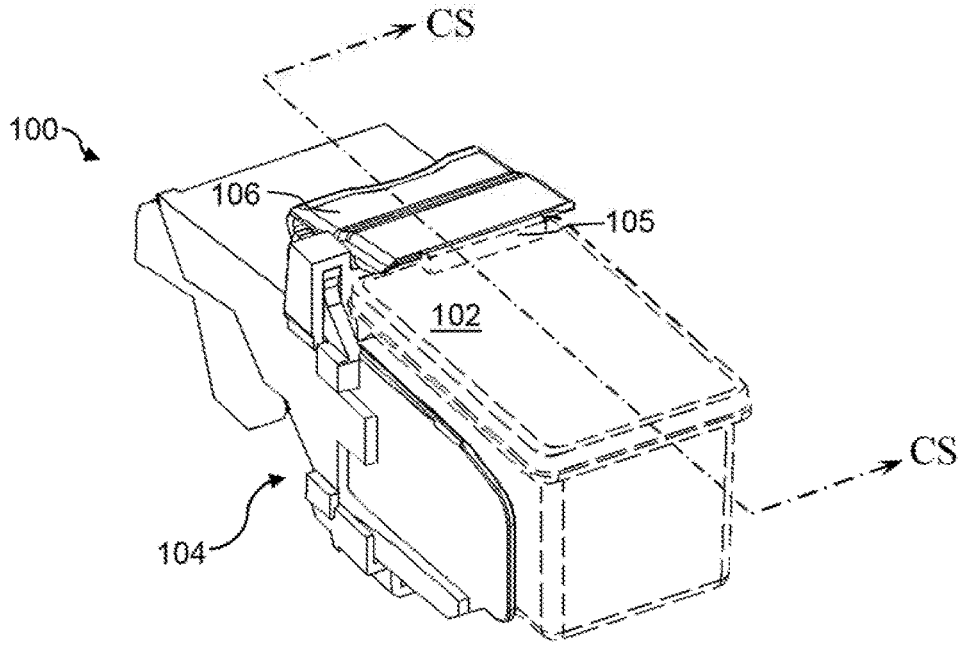
FIG. 1C is a perspective view of an example retainer.

Referring now to FIG. 1C, a perspective view of an example retainer 100 is illustrated with a cartridge 102 shown installed into the retainer 100. Further, FIG. 1C illustrates the cartridge 102 installed into the retainer 100, such that the cartridge is received by the carriage 104, in implementations comprising a carriage 104. Note that the retainer 100, in other implementations, may receive and retain the cartridge 102 through another structural orientation, without the retainer 100 comprising a carriage 104.

The retainer 100 may comprise a latch 106. The latch 106 may be a rigid or semi-rigid component that is capable of removably engaging with the cartridge 102. Further, the latch 106 may retainably and releasably engage with the cartridge 102. In other words, the latch 106 may engage with the cartridge in a locked position, or may be removed from engagement with the cartridge 102 to a released position. The cartridge 102 may be retained, or fixed to or within the retainer 100 in an operable position, when the latch 106 is in the locked position, and the cartridge 102 may be removable from the retainer 100 when the latch 106 is in the released position. An operable position may refer to a position of the cartridge 102 wherein the cartridge 102 is able to deposit print substance on print media during a printing operation of the printing system 101. The latch 106 is illustrated as being in the released position in FIGS. 1B-C, whereby the latch is not retaining or fixing the cartridge 102 to or within the retainer 100. In some implementations, such as implementations wherein the retainer 100 comprises a carriage 104, the carriage 104 is to insertably receive the cartridge 102 in the operable position, and the latch 106 is to operably fix the cartridge 102 within the carriage 104 when in the locked position, and the cartridge 102 is to be removable from the carriage 104 when the latch is in the released position.

Figure 2A:
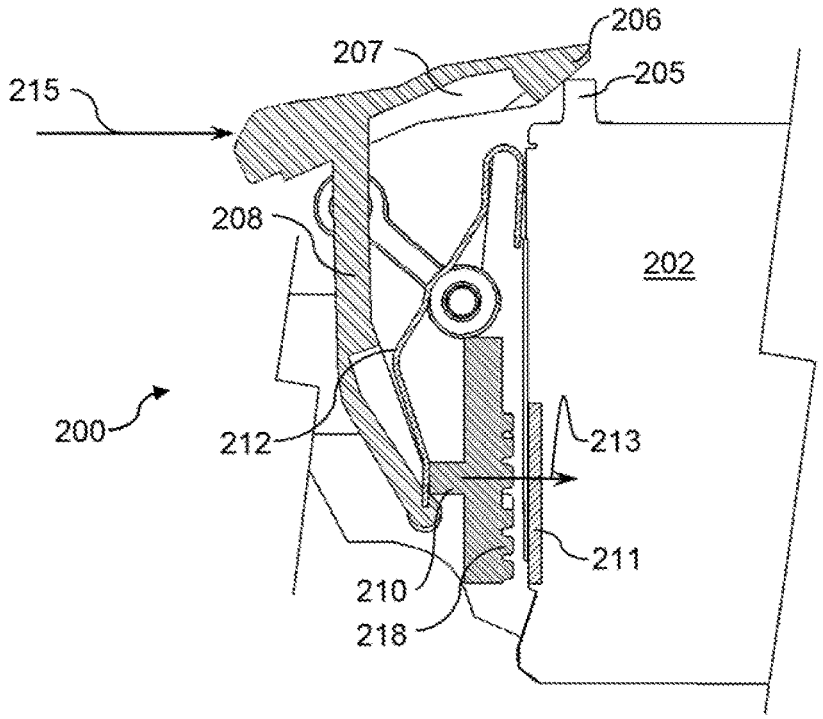
FIG. 2A is a partial cross-sectional view of an example retainer.

Referring now to FIG. 2A, a partial cross-sectional view taken along view line CS-CS of FIG. 1C of an example retainer 200 is illustrated. Example retainer 200 may be similar to example retainer 100. Further, the similarly named elements of example retainer 200 may be similar in function and/or structure to the elements of example retainer 100, as they are described above. The example retainer 200 may include a latch 206, an actuator plate 210, a bias member 212, and a linkage 208. The latch 206 is illustrated in FIG. 2A as being in the released position, whereby a cartridge 202 is not retained or fixed within the retainer 200, or a carriage 204 thereof. The latch 206 may, in some implementations, engage with a retaining tab 205 of the cartridge 202. In order to engage with such a retaining tab 205, the latch 206 may include a cavity 207 to receive, hook on to, or engage with the retaining tab 205 when the latch 206 is disposed in the locked position. As the latch 206 is illustrated in FIG. 2A as being in the released position, the retaining tab 205 is not engaged with the cavity 207.

The retainer 200 may further include an actuator plate 210, which may comprise a communication interface. The actuator plate 210 may be to operably engage with the cartridge 202, also comprising a communication interface, such that, upon engagement with the cartridge 202, the transmission of data signals can occur between the actuator plate 210 and the communication interface of the cartridge 202. The data signals may be electrical signal, optical signals, or other signals capable of transmitting data. In some implementations, the actuator plate 210 may include a signal interconnect 218 as the communication interface to operably engage with a complementary signal interconnect 211 disposed on the cartridge 202, when the actuator plate 210 is operably engaged with the cartridge 202. The signal interconnect 218, and the complementary signal interconnect 211 may exchange data signals when engaged with one another such that the cartridge 202 may communicate with the printing system, and vice versa. In some implementations, the actuator plate 210 may engage with the cartridge 202 by moving in a direction 213. In some implementations, the direction 213 may be substantially normal, or perpendicular to the cartridge 202 or the signal interconnect 211 therein. In this context, the actuator plate 210 moving in a direction 213 substantially normal or perpendicular to the cartridge 202 may mean that the actuator plate 210 engages with the cartridge 202 in a manner that avoids or prevents scraping or sliding against the cartridge 202 to a degree that is sufficient to damage the actuator plate 210, any signal interconnect 218 thereon, or the cartridge 202, or any complementary signal interconnect 211 thereon.

Further, the retainer 200 may include a bias member 212. The bias member 212 may be elastically deformable, or, in other words, a resilient component that can return to is original shape after being deformed. In some implementations, the bias member 212 may provide a reactive force proportional to the degree of deformation of the bias member 212. The reactive force may be proportionate to the deformation of the bias member 212 in a linear, a progressive, or a degressive manner. In some implementations, the reactive force may be a constant reaction to the deformation of the bias member 212. In further implementations, the bias member 212 may be a component comprising a material such as sheet steel or spring steel, or another flexible material, having a bent or bendable geometry. In yet further implementations, the bias member 212 may be a leaf spring. In other implementations, the bias member 212 may be a torsion, an extension, or a compression spring.

The bias member 212 may be engaged with the retainer 200 such that it is to push the actuator plate 210 against the cartridge 202. In some implementations, the bias member 212 is to push the actuator plate 210 along direction 213 such that the actuator plate 210 operably engages with the cartridge 202. In further implementations, the bias member is to push the actuator plate 210 against the cartridge 202 such that the actuator plate 210 operably engages with the cartridge 202 upon the latch 206 being moved from the released position to the locked position with the cartridge 202. Once the latch 206 is moved from the released position to the locked position, the bias member 212 may push the actuator plate 210 against the cartridge with sufficient force such that signal communication may occur between the cartridge 202 and the printing system through the engagement of the actuator plate 210 with the cartridge 202.

The retainer 200 may also include a linkage 208. The linkage 208 may be engaged with both the latch 206 and the actuator plate 210 such that the linkage 208 links, or engages the actuator plate 210 with the latch 206. In some implementations, the linkage 208 and the latch 206 may be a unitary component, as illustrated in FIG. 2A. In further implementations, the unitary component may be pliable, or elastically transformable, such that the latch 206 is movable relative to the linkage 208, despite their unitary structure. In yet further implementations, the latch 206 may be biasedly movable relative to the linkage 208, or, in other words, if the latch 206 is moved or bent relative to the linkage 208, the unitary nature of the two components may exert a reactive force on the latch 206, puling the latch towards its original, resting position.

Further, the linkage 208 may link the latch 206 to the actuator plate 210 such that the actuator plate 210 moves upon the latch 206 being moved. Additionally, the linkage 208 may be engaged with the bias member 212. In some implementations, the linkage 208 may be directly engaged with the actuator plate 210 such that the linkage 208 causes the movement of the actuator plate 210 through direct contact. In other implementations, the linkage 208 may be engaged with the actuator plate through an intermediary component, such that, upon the latch 206 being moved, the linkage 208 moves the intermediary component, which, in turn, moves the actuator plate 210. In further implementations, the bias member 212 may be the intermediary component such that the linkage 208 is engaged with the actuator plate 210 through the engagement of the bias member 212 with both the linkage 208 and the actuator plate 210. In other words, movement of the latch 206 from the released position to the locked position, for example, along direction 215, may shift or move the linkage 208 so that it may contact or push against the bias member 212, which, in turn, may push against the actuator plate 210 along direction 213, as described above.

Figure 2B:
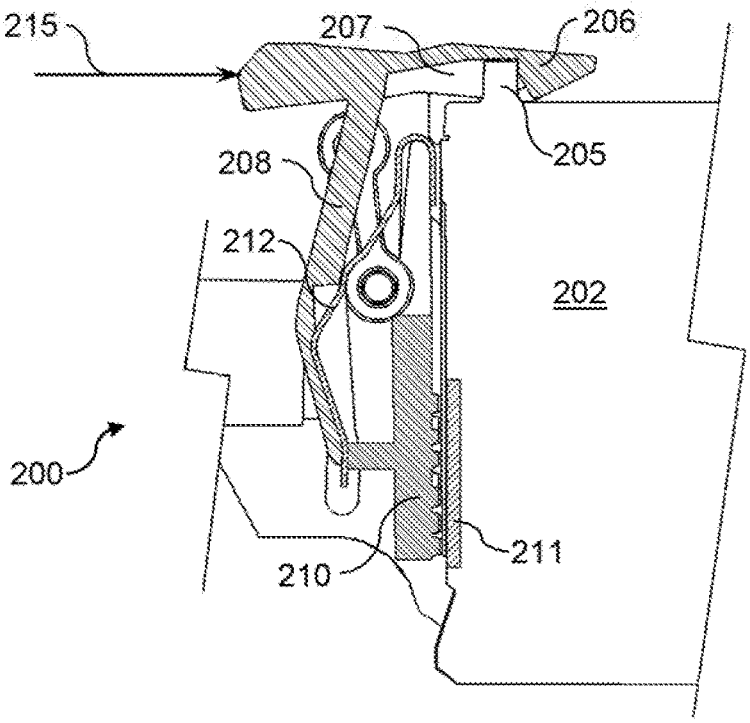
FIG. 2B is a partial cross-sectional view of an example retainer.

Referring additionally to FIG. 2B, a partial cross-sectional view of example retainer 200 is illustrated, wherein the latch 206 has been moved along example direction 215 from the released position, and is now illustrated in the locked position. The latch 206 may be moved along direction 215 by a motive force, such as the hand or finger of a user pressing on a back portion, or a portion generally opposite from the location of the cartridge 202, of the latch 206. In other implementations, the motive force may be supplied by another component or element of the printing system pushing on such a back portion of the latch 206, along direction 215. Such a motive force may have caused the latch 206 to contact the tab 205, in some implementations, thereby also bending the latch 206 in an upward direction, relative to the linkage 208, in order to overcome the retaining tab 205, and continue to be moved to the locked position. As described above, the unitary nature of the latch 206 and the linkage 208 may have caused the latch 206 to return to its original position relative to the linkage 208, in a downward direction, once the latch 206 overcame the tab 205, and the tab 205 was able to insert into and be received by the cavity 207, disposing the latch 206 in a latched position with the cartridge 202. Additionally, the biasedly movable nature of the latch 206 relative to the linkage 208, as well as the retaining tab 205 now being hooked, or disposed within the cavity 207, may prevent the latch 206 from moving out of the latched and locked positions and back towards the released position unless another motive force pushes or bends the latch 206 in an upwards direction again so that the latch 206 is unhooked from the retaining tab 205.

The linkage 208, as described above, may have been moved along with the latch 206 by the motive force. The linkage 208 may have contacted or pushed on the bias member 212 throughout the movement of the linkage 208. Such a motion exerted upon the bias member 212 may cause the bias member 212 to thereby move the actuator plate 210 along direction 213 until the actuator plate 210 operably engages with the cartridge 202, as shown in FIG. 2B, and the actuator plate 210 and the cartridge 202 can exchange data signals. In some implementations, after operable engagement between the actuator plate 210 and the cartridge 202 is reached, the latch 206, and thus the linkage 208, may continue along direction 215 until the latch 206 fully reaches the locked position. While the actuator plate 210 may not move any further along direction 213 during such extended movement of the latch 206, the linkage 208 may continue pushing against the bias member 212, which, in turn, may plastically deform and exert a reactive force, or a pretension force, against the actuator plate 210. This reactive force may ensure that sufficient engagement force is present between the actuator plate 210 and the cartridge 202, so that a robust data connection is made, and data communication can occur between the cartridge and the printing system.

Figure 2C:
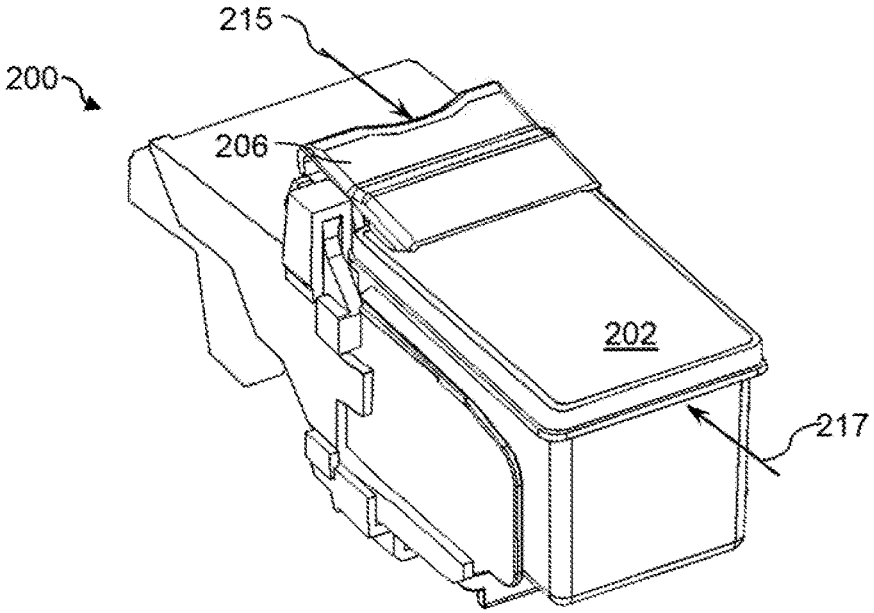
FIG. 2C is a perspective view of an example retainer.

Referring additionally to FIG. 2C, a perspective view of an example retainer 200 is shown, illustrating the application of a motive force causing the latch 206 to move to the locked position. The latch 206 is illustrated in FIG. 2C as being in the locked position. In some implementations, if the motive force causing the movement of the latch 206 along direction 215 is provided by a user, or a hand or finger thereof the motive force may be applied in a squeezing motion, as shown. The user, for example, may place one finger or thumb on the back portion of the latch 206, and another finger or thumb on a substantially opposite location on the cartridge 202, and squeeze the two appendages towards one another until the latch 206 moves to the locked position. In this context, substantially opposite many refer to any location along the cartridge 202 where a force can be applied, for example, along direction 217, such that, upon moving the latch 206 towards the locked position, the cartridge 202 is held in place and does not move away from the latch 206. In other implementations, the cartridge 202 may be sufficiently held in place by the retainer 200, the carriage 204, or other components or elements of the printing system, such that applying a motive force in one direction against the latch 206, for example, direction 215, may be sufficient to move the latch 206 relative to the cartridge 202 and into the locked position.

Figure 2D:
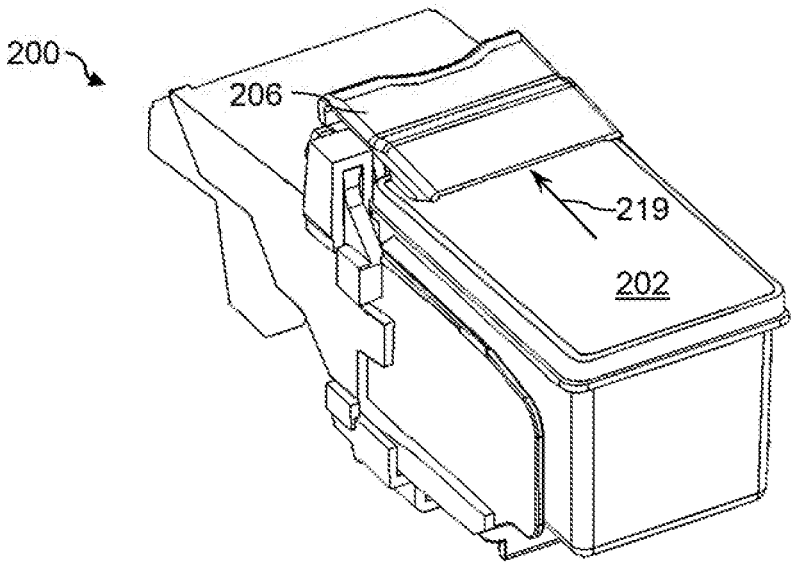
FIG. 2D is a perspective view of an example retainer.
Figure 2E:
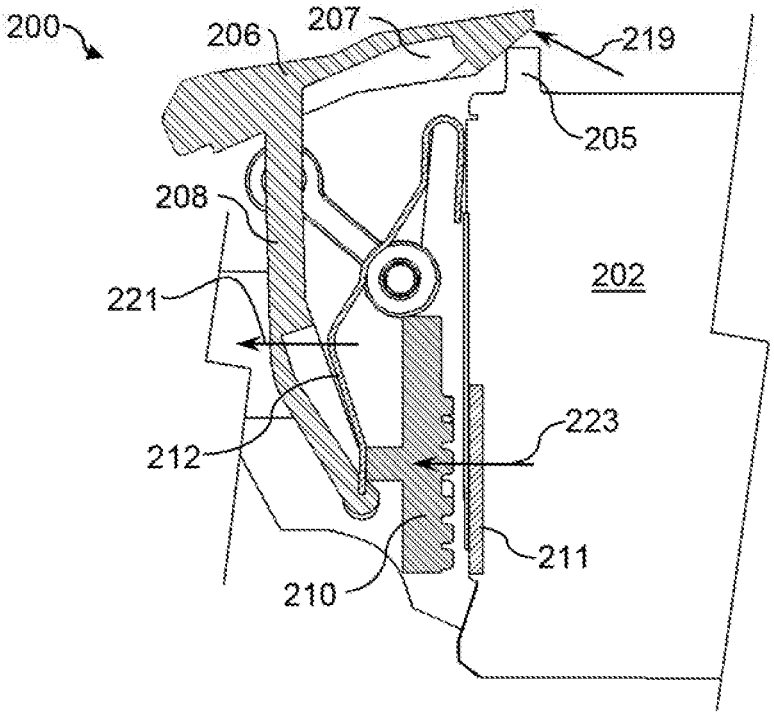
FIG. 2E is a partial cross-sectional view of an example retainer.

Referring now to FIG. 2D, a perspective view of an example retainer 200 is illustrated, in which the latch 206 is shown in the locked position. The latch 206 may be moved from the locked position, back to the released position. Once the latch 206 is in the released position, the cartridge 202 may be removed from the retainer 200, and thus, the printing system. In order to move the latch 206 to the released position, a motive force, such as exerted by a user, for example, may be applied against the latch 206 in an example direction 219, which, in some implementations, may be substantially opposite to the direction that the latch 206 moved in to reach the locked position. Referring additionally to FIG. 2E, a partial, cross-sectional view of an example retainer 200 is illustrated, wherein the latch 206 has been moved to the released position from the locked position. A motive force may be applied along example direction 219, as described above regarding FIG. 2B, until the latch 206 is bent upwards, against the biasedly movable nature of the latch 206, a sufficient amount so as to unhook the retaining tab 205 from the cavity 207, and, thus, the latch 206. Once the retaining tab 205 is released from the cavity 207, the latch 206 may be free to continue moving from the locked position to the released position.

Additionally, once the latch 206 has overcome the retaining tab 205, the pretension force, or the reactive force of the bias member 212 may, instead of pushing the actuator plate 210 against the cartridge 202, push against the linkage 208, along example direction 221, until the pretension force or the reactive force is fully released, and the bias member 212 is back in its original form. As the linkage is moved along example direction 221, the actuator plate 210 may, in turn, be moved by the bias member 212 along example direction 223, until the actuator plate is fully disengaged from the cartridge 202, and the latch 206 is in the released position. Once the actuator plate 210 is fully disengaged from the cartridge 202, and the latch is in the released position, the cartridge may be removed from the retainer 200 without causing damage to the communication interface of the actuator plate, or the complementary communication interface of the cartridge 202.

Figure 3:
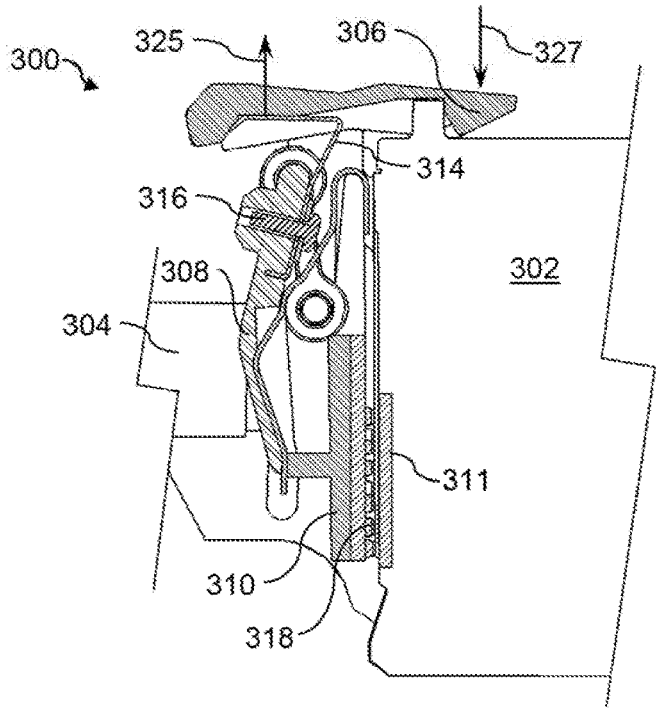
FIG. 3 is a partial cross-sectional view of an example retainer.

Referring now to FIG. 3, a partial cross-sectional view of an example retainer 300 of a printing system is illustrated. Example retainer 300 may be similar to example retainer 100 or 200. Further, the similarly named elements of example retainer 300 may be similar in function and/or structure to the elements of example retainer 100 or 200, as they are described above. The retainer 300 may comprise a latch 306, shown in a locked position with a cartridge 302. Further, the retainer 300 may comprise an actuator plate 310, a bias member 312, and a linkage 308. The latch 306, and the linkage 308, in some implementations, may be separate components. Further, the latch 306 may be engaged with the linkage 308 through a second bias member 314. In some implementations, the second bias member 314 may be a second bias portion of the bias member 312. In further implementations, the second bias member 314 may be fastened or attached to the bias member 312. In other implementations, the second bias member 314 and the bias member 312 are a unitary component. In yet further implementations, the second bias member 314 is a completely separate component from the bias member 312, and not attached or fastened to the bias member 312, as illustrated in FIG. 3.

The second bias member 314 may be fastened or attached to the linkage 308, and engaged with e latch 306. The second bias member 314, in some implementations, may be attached to the linkage 308 through the use of a mechanical fastener 316, as shown in FIG. 3. In other implementations, the second bias member 314 may be fastened or attached to the latch 306, and engaged with the linkage 308. In yet further implementations, the second bias member 314 may be engaged with both the linkage 308 and the latch 306, such that the second bias member 314 is to bias the latch 306 to a latched position when the latch 306 is engaged with the cartridge in a locked position. The second bias member 314 may bias the latch 306 to the latched position by exerting a force, for example, in a direction 325 against the latch 306, when the hitch 306 is in the locked position. The force exerted in example direction 325 may cause the latch 306 to bias, for example, in a direction 327, or towards the latched position with the cartridge 302.

The actuator plate 310 of the retainer 300 may include a signal interconnect 318 to operably engage with a complementary signal interconnect 311 disposed on the cartridge 302. In some implementations, the signal interconnect 318 may be a separate component that is attached or fastened to the actuator plate 310. In other implementations, the signal interconnect 318 may be a standalone component from the actuator plate 310, and may be slidably or movably attached to a carriage 304 of the retainer 300, or another component or element of the printing system. In further implementations, the signal interconnect 318 may be fixed to the retainer 300, the carriage 304 thereof or another printing system component, and comprise a malleable, bendable, or otherwise elastically deformable material. Such a material may enable the actuator plate 310 to deform, push, or bend the signal interconnect 318 towards the complementary signal interconnect 311 of the cartridge such that the signal interconnect 318 operably engages with the complementary signal interconnect 311, and the exchange of data signals between the two may occur.

Figure 4:
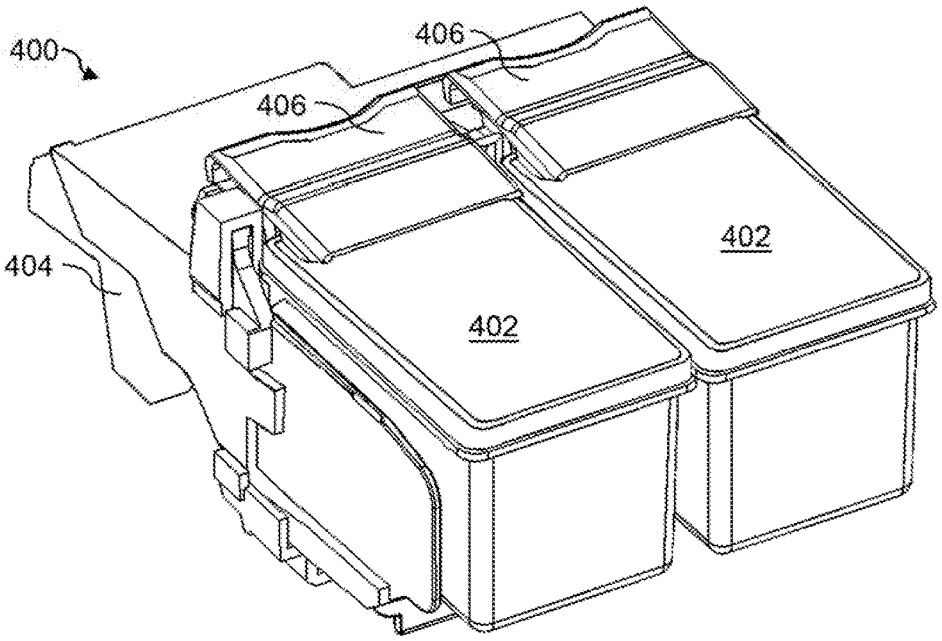
FIG. 4 is a perspective view of an example retainer.

Referring now to FIG. 4, a perspective view of an example retainer 400 of a printing system is illustrated. Example retainer 400 may be similar to example retainer 100, 200, or 300. Further, the similarly named elements of example retainer 300 may be similar in function and/or structure to the elements of example retainer 100, 200, or 300, as they are described above. The retainer 400, in some implementations, may comprise a carriage 404 that may receive multiple cartridges 402, as shown in FIG. 4. The retainer 400 may further comprise a separate latch 406 for each of the separate cartridges 402, such that each cartridge 402 may be individually installed and/or removed from the retainer 400, apart from the other cartridges 402. In further implementations, each latch 406 may correspond to a separate linkage, bias member, and actuator plate, such that each latch 406 is individually movable from a released position to a locked position with its corresponding cartridge 402, and vice versa.

What is claimed is:

1. A retainer, comprising:

a latch to removably engage with a removable element;

an actuator plate to operably engage with the removable element such that, upon engagement with the removable element, the transmission of signals can occur between the actuator plate and the removable element;

a bias member to push the actuator plate against the removable element; and a linkage engaged with the actuator plate, the bias member, and the latch, such that the linkage pushes against the bias member to cause the bias member to push the actuator plate against the removable element upon the latch being engaged with the removable element in a locked position.

2. The retainer of claim 1, wherein the latch is biasedly movable relative to the linkage, such that the latch is biased towards a latched position with the removable element, when engaged with the removable element in the locked position.

3. The retainer of claim 2, wherein the latch and the linkage are a unitary component, and wherein the unitary component is pliable, such that the latch is biasedly movable relative to the linkage.

4. The retainer of claim 2, wherein the latch and the linkage are separate components, and wherein the latch is engaged with the linkage such that the latch is movable relative to the linkage.

5. The retainer of claim 4, wherein the latch is engaged with the linkage through a second bias member, such that the latch is biased towards the latched position by the second bias member.

6. The retainer of claim 1, wherein the removable element is a cartridge.

7. A retainer, comprising:

a latch to engage with a cartridge within a carriage in a locked position and a released position, the latch biased towards a latched position with the cartridge when in the locked position;

an actuator plate to operably engage with the cartridge such that, upon engagement with the cartridge, the transmission of signals can occur between the actuator plate and the cartridge;

a bias member; and a linkage to engage the actuator plate with the latch, the linkage to push against the bias member such that the bias member pushes the actuator plate against the cartridge upon the latch being moved to the locked position with the cartridge from the released position.

8. The retainer of claim 7, wherein the latch is to operably fix the cartridge within the carriage when in the locked position with the cartridge, and the cartridge is removable from the carriage when the latch is in the released position.

9. The retainer of claim 8, further comprising a second bias member to bias the latch towards the latched position when the latch is engaged with the cartridge in the locked position.

10. The retainer of claim 9, wherein the bias member and the second bias member are a unitary component such that the second bias member is a second bias portion of the bias member, the second bias portion to bias the latch towards the latched position when the latch is engaged with the cartridge in the locked position.

11. The retainer of claim 8, wherein the latch and the linkage are a unitary component, wherein the unitary component is pliable such that the latch is biasedly movable relative to the linkage.

12. A printing system, comprising:

a carriage disposed within the printing system to receive a cartridge; and a retainer to retain the cartridge within the carriage, the retainer comprising:

a latch to retainably and releasably engage with the cartridge;

an actuator plate to operably engage with the cartridge such that, upon engagement with the cartridge, the transmission of signals can occur between the actuator plate and the cartridge;

a bias member; and a linkage to engage the actuator plate with the latch, the linkage to push against the bias member such that the bias member pushes the actuator plate against the cartridge upon the latch being moved to a locked position with the cartridge from a released position.

13. The printing system of claim 12, wherein the carriage is to insertably receive the cartridge in an operable position, and wherein the retainer is to fix the cartridge in the operable position upon the latch being moved from the released position to the locked position.

14. The printing system of claim 13, wherein the actuator plate comprises a signal interconnect to operably engage with a complementary signal interconnect disposed on the cartridge, when the actuator plate is operably engaged with the cartridge.

15. The printing system of claim 14, wherein, upon the cartridge being fixed in the operable position by the retainer, the transmission of signals may occur between the cartridge and the printing system through the signal interconnect of the actuator plate, and the complementary signal interconnect of the cartridge.

* * * * *